US007959771B2

(12) United States Patent
Grass et al.

(10) Patent No.: US 7,959,771 B2
(45) Date of Patent: Jun. 14, 2011

(54) ELECTROPHORETIC DIP COATING PLANT

(75) Inventors: Ingo Grass, Remscheid (DE); Zoltan-Josef Horvath, Holzgerlingen (DE)

(73) Assignee: Eisenmann Anlagenbau GmbH & Co. KG, Boeblingen (DE)

( * ) Notice: Subject to any disclaimer, the term of this patent is extended or adjusted under 35 U.S.C. 154(b) by 1217 days.

(21) Appl. No.: 11/638,099

(22) Filed: Dec. 13, 2006

(65) Prior Publication Data

US 2007/0144433 A1 Jun. 28, 2007

(51) Int. Cl.
*C25D 17/08* (2006.01)

(52) U.S. Cl. ..... 204/229.2; 204/228.2; 204/229.4; 204/229.5; 204/229.7

(58) Field of Classification Search ..... 204/228.2, 204/229.2, 229.4, 229.5, 229.7
See application file for complete search history.

(56) References Cited

U.S. PATENT DOCUMENTS

2007/0261953 A1* 11/2007 Kohler et al. ..... 204/230.2

FOREIGN PATENT DOCUMENTS

| | | | |
|---|---|---|---|
| DE | 1260355 | | 2/1968 |
| DE | 1804107 | | 4/1970 |
| JP | 08246194 A | * | 9/1996 |
| WO | WO 2006066920 A1 | * | 6/2006 |

* cited by examiner

*Primary Examiner* — Alexa D. Neckel
*Assistant Examiner* — Nicholas A. Smith
(74) *Attorney, Agent, or Firm* — Factor & Lake, Ltd.

(57) ABSTRACT

An electrophoretic dip coating plant comprises at least one dip tank, which is filled with a coating fluid. The objects which are to be coated are carried by means of a conveyor system through the coating fluid located in the dip tank and are then in electrical contact with a bus bar arrangement comprising an input and/or output region and a main region. The main region of the bus bar arrangement is connected to one terminal of a d.c. voltage supply unit. The other terminal of this d.c. voltage supply unit is electrically connected to at least one electrode which is immersed in the coating fluid in the dip tank. In order to enable the voltages which are applied to the adjacent regions of the bus bar arrangement to be regulated independently of one another, yet still to manage with a single d.c. voltage supply unit, the adjacent regions are connected together via a controllable semiconductor switch which is capable of transferring the voltage which is applied to the main region at a controllable magnitude to the input and/or output region of the bus bar arrangement.

6 Claims, 1 Drawing Sheet

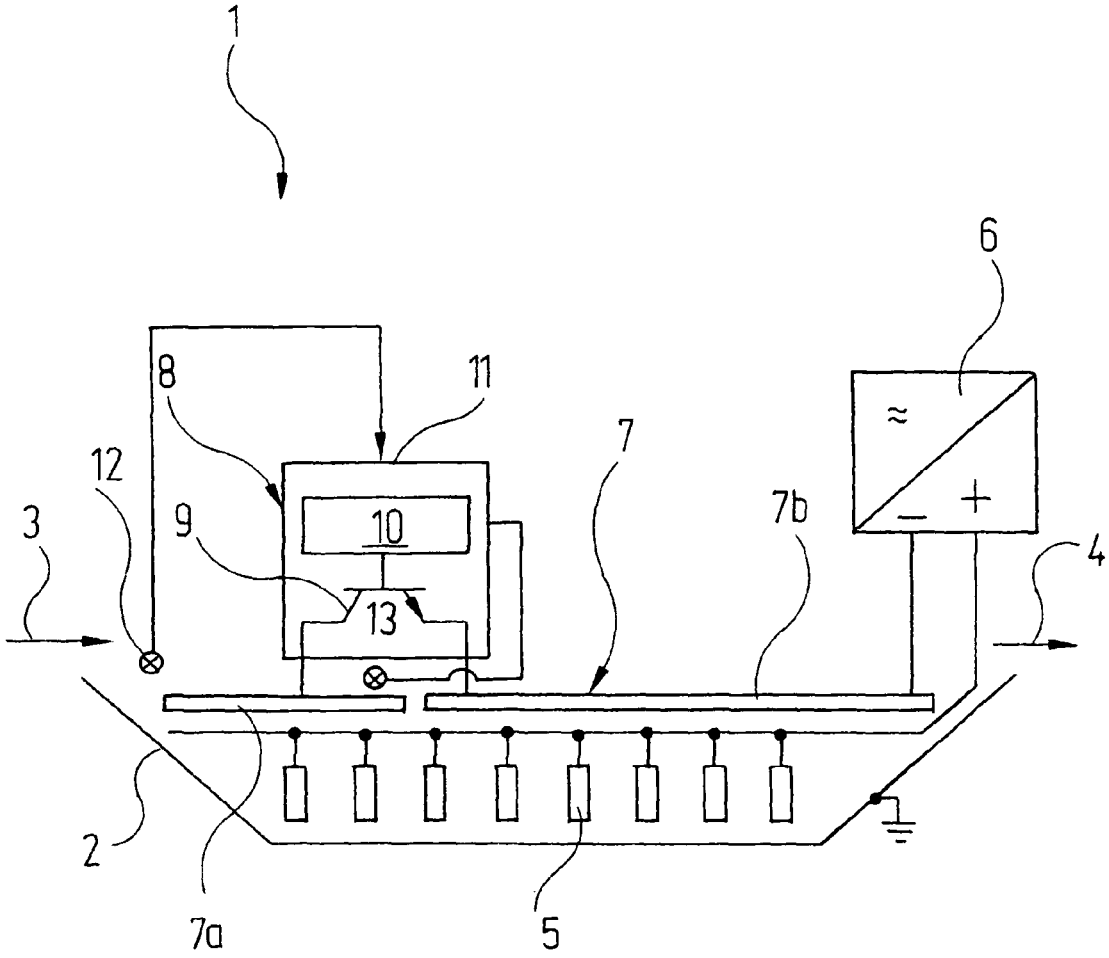
1
6
8
11
7
12
10
7b
3
9
13
4
2
7a
5

ELECTROPHORETIC DIP COATING PLANT

RELATED APPLICATIONS

This application relates to German Patent Application No. DE 102005049712.8, filed Oct. 18, 2005.

TECHNICAL FIELD

This invention relates to an electrophoretic dip coating plant with at least one dip tank, which is filled with a coating fluid;

a conveyor system, which brings the objects which are to be coated up to the dip tank, immerses them in the coating fluid at one end region of the dip tank, carries them through the coating fluid to the other end region of the dip tank, where it moves them out of the coating fluid and away from the dip tank;

at least one electrode of a first polarity disposed in the dip tank;

a bus bar arrangement which runs along the path of movement of the objects, with which the objects can be brought into electrical contact upon passing through the dip tank and which is electrically divided into an input and/or output region and at least one main region following in the direction of movement of the objects; and, a d.c. voltage supply unit, one terminal of which is connected to the electrode of the first polarity and the other terminal of which is connected to the bus bar arrangement, wherein the voltage which is applied to the input and/or output region of the bus bar arrangement can be adjusted independently of the voltage which is applied to the main region.

BACKGROUND OF THE INVENTION

When carrying out electrophoretic dip coating it should be possible to bring the objects which are to be coated to different potentials during the passage through the dip tank. This is on the one hand connected with the fact that during the actual immersion operation different regions of the object which is to be coated come into contact with the coating fluid for periods of different length and regions with different coating thicknesses would therefore result in the absence of appropriate countermeasures. On the other hand the fact that the deposited layer thickness and the electrical contact resistance increase and therefore the deposition speed decreases as the objects pass through the dip tank is taken into account by the different voltage which is applied to the objects. The bus bar arrangement of known electrophoretic dip coating plant is therefore generally divided into different regions which can be brought to different potentials. In this respect steps should be appropriately taken to ensure that at the moment at which the objects which are to be coated pass over from one region of the bus bar arrangement to the adjacent one both regions lie at the same potential; otherwise dangerous sparks could occur.

In the case of known electrophoretic dip coating plant of the type initially mentioned which are currently on the market each region of the bus bar arrangement is fed by a particular rectifier with which a particular electronic voltage regulating unit is associated. This is relatively expensive at the current strengths which are required for electrophoretic dip coating.

The present invention is directed to solving these and other matters.

SUMMARY OF THE INVENTION

The object of the present invention is to develop an electrophoretic dip coating plant of the type initially mentioned such that the expenditure on apparatus and therefore the investment costs are reduced.

This object is achieved in accordance with one embodiment of the present invention in that a common d.c. voltage supply unit is provided for the input and/or output region and the main region, the corresponding terminal of which unit is connected to the main region; and, the input and/or output region is connected to the main region of the bus bar arrangement via a controllable semiconductor switch such that the voltage which is applied to the main region can be transferred at a controllable magnitude to the input and/or output region.

As such, the present invention consequently succeeds with a single rectifier and an associated regulating circuit. The voltage which is delivered by this common d.c. voltage supply unit in the first place serves primarily to feed the main region of the bus bar arrangement; the voltage prevailing at the input and/or output region of the bus bar arrangement is "derived" from the voltage of the main region by being transferred by means of the controllable semiconductor switch at full magnitude or only partly to the input and/or output region. A controllable semiconductor switch of this kind is far more attractively priced than a further d.c. voltage supply unit, which would otherwise be necessary.

The controllable semiconductor switch expediently comprises a power transistor and a logic circuit, the logic circuit being programmed such that it delivers pulse-width-modulated pulses at a certain repetition frequency to turn on the power transistor. The pulse-width modulation of a power transistor is a particularly loss-free way of reducing in a variable manner the voltage which is applied to the main region of the bus bar arrangement and delivered directly by the d.c. voltage supply unit to the value which is at the time required at the input and/or output region of the bus bar arrangement.

The logic circuit may in particular be programmed such that on the basis of a start signal it generates pulses initially with a small width and then, over a certain time, pulses with an increasing width. This takes account of the requirement to initially immerse the objects unenergised, as far as possible, in the coating fluid and to gradually increase the voltage which is applied to them until it has reached the full value prevailing in the adjacent main region.

The above-mentioned start signal may be generated by a presence sensor which is disposed in the inlet region of the dip tank and detects the approach of an object.

A presence sensor may also be disposed in the end portion of the input region of the bus bar arrangement which is adjacent to the main region of the bus bar arrangement and/or in the end portion of the main region which is adjacent to the output region. When an object approaches this delivers a signal to the logic circuit, whereby the input and/or output region of the bus bar arrangement is brought to the potential of the main region. This represents a safety measure to ensure that at the moment at which the object passes over from the input region to the main region or from the main region to the output region both regions are in any case at the same potential, irrespective of whether this has also been effected at this instant by the program which is stored in the logic circuit.

As already indicated above, in many cases electrophoretic dip coating plant do not just have one main region, but a plurality which adjoin one another in the direction of movement. In this case it is expedient, for the above-mentioned reasons, for at least two adjacent main regions to be connected in an appropriate manner by a controllable semiconductor switch, as indicated in claims 1 to 5 for the connection between the input region and the main region of the bus bar circuit. This measure also makes it possible to dispense with additional d.c. voltage supply units, which were necessary in the prior art, or to replace them by the more attractively priced controllable semiconductor switch.

BRIEF DESCRIPTION OF THE DRAWINGS

An embodiment of the invention is illustrated in detail in the following on the basis of the drawing; the sole FIGURE shows in a schematic vertical section a plant for cataphoretic dip coating with associated circuit arrangement.

DETAILED DESCRIPTION OF THE INVENTION

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

The plant which is represented in the drawing for cataphoretic dip coating and is marked as a whole by the reference number 1 serves in particular to undercoat vehicle bodies in a continuous dipping process. It comprises a dip tank 2 which is represented in a vertical section and is filled up to a certain level with an appropriate coating fluid. The vehicle bodies which are to be coated are brought up to the dip tank 2 in the direction of the arrow 3 by means of a suitable conveyor system, which is not represented, then immersed in the coating fluid in a first region, moved through the coating fluid, lifted out of the coating fluid in the end region of the dip tank 2 and then removed in the direction of the arrow 4 for further treatment.

A plurality of anodes 5 are immersed in the coating fluid on both sides of the path of movement of the vehicle bodies, which anodes are connected to the positive terminal of a regulated rectifier 6. A bus bar arrangement 7 also extends parallel to the path of movement of the vehicle bodies, which arrangement preferably runs above the surface of the coating fluid and is divided into an input region 7*a* and a main region 7*b*.

The main region 7*b* of the bus bar arrangement 7 is connected to the negative terminal of the regulated rectifier 6. The input region 7*a* of the bus bar arrangement extends in the direction of movement of the vehicle bodies at least up to a point at which the vehicle bodies are completely immersed in the coating fluid.

The input region 7*a* is connected to the main region 7*b* of the bus bar arrangement 7 by a controllable semiconductor switch 8, in the present case an IGBT circuit. This in turn comprises a controllable power transistor 9 as well as a logic circuit 10, which drives the latter. A certain control program, which is illustrated in detail in the following, for the power transistor 9 is stored in the logic circuit 10, which program is started when a start signal arrives at an input 11 of the IGBT circuit 8.

The dip coating plant 1 which is described above works as follows:

At the outset, i.e. before a vehicle body enters the dip tank 2, the power transistor 9 is inhibited, so that the input region 7*a* of the bus bar arrangement 7 is therefore unenergised. The main region 7*b* may at this instant likewise be unenergised, although is also already at the normal operating voltage.

The vehicle bodies approaching in the direction of the arrow 3 are detected at the inlet of the dip tank 2 by an inlet sensor 12. This delivers the start signal to the input 11 of the IGBT circuit, so that the logic circuit 10 starts to run the stored program. At this instant at the latest the main region 7*b* lies at operating voltage and the vehicle body is electrically connected to the input region 7*a* of the bus bar arrangement 7, which is at the time still at zero potential.

The logic circuit 10 now generates at a certain repetition frequency, e.g. 500 Hertz, pulse-width-modulated voltage pulses which open the power transistor 9 for their duration. At the beginning of the program, i.e. shortly before the vehicle bodies enter the input region 7*a* of the bus bar arrangement 7, the duration of these pulses is still very short, although increases continuously during the passage through the input region 7*a*, even though not necessarily in linear fashion.

The mean voltage to which the vehicle bodies are exposed increases accordingly during the movement of the latter along the input region 7*a*. Shortly before reaching the end of the input region 7*a* the widths of the pulses are so great that a continuous d.c. voltage is produced, this being substantially equal to the voltage in the main region 7*b* of the bus bar arrangement 7.

During the movement of the vehicle bodies in the input region 7*a* of the bus bar arrangement 7 a first deposition of coating on their surfaces takes place.

No sparks can occur when the vehicle bodies pass over from the input region 7*a* to the main region 7*b* of the bus bar arrangement 7, as both bus bar regions 7*a*, 7*b* are at the same potential at this instant. The vehicle bodies now pass through the main region 7*b* of the bus bar arrangement 7, where they are coated to the desired thickness with coating.

In order to ensure that when the vehicle bodies pass over from the input region 7*a* to the main region 7*b* of the bus bar arrangement 7 there is no possibility of a potential difference between these, a further presence sensor 13 is disposed along the path of movement of the vehicle bodies shortly before reaching the end of the input region 7*a*. Once the vehicle body enters the detection range of the presence sensor 13, this generates a signal which causes the logic circuit 10 of the IGBT circuit 8 to bring the input region 7*a* to the same potential as the main region 7*b*, irrespective of the stored program.

The operations described above for the input region 7*a* of the bus bar arrangement 7 may also take place in an analogous manner in an output region of the bus bar arrangement 7, in which case, however, the pulse width of the voltage pulses decreases in the direction of movement of the vehicle bodies.

It should be emphasized that the above-described embodiments of the present invention, particularly, any "preferred" embodiments, are possible examples of implementations merely set forth for a clear understanding of the principles of the invention. Many variations and modifications may be made to the above-described embodiments of the invention without substantially departing from the spirit and principles of the invention. All such modifications are intended to be included herein within the scope of this disclosure and the present invention, and protected by the following claims.

The invention claimed is:

1. An electrophoretic dip coating plant comprising: at least one dip tank, which is filled with a coating fluid; a conveyor system, which brings the objects which are to be coated up to the dip tank, immerses them in the coating fluid at one end region of the dip tank, carries them through the coating fluid to the other end region of the dip tank, where it moves them out of the coating fluid and away from the dip tank; at least one electrode of a first polarity disposed in the dip tank; a bus bar arrangement which runs along the path of movement of the objects, with which the objects can be brought into electrical contact upon passing through the dip tank and which is galvanically divided into an input and/or output region and at least one main region following in the direction of movement of the objects; a d.c. voltage supply unit, one terminal of which is connected to the electrode of the first polarity and the other terminal of which is connected to the bus bar arrangement, wherein the voltage which is applied to the input and/or output region of the bus bar arrangement can be adjusted independently of the voltage which is applied to the main region a common d.c. voltage supply unit is provided for the input and/or output region and the main region of the bus bar arrangement, the corresponding terminal of which unit is connected to the main region; and, the input and/or output region is connected to the main region of the bus bar arrangement via a controllable semiconductor switch such that the voltage which is applied to the main region can be transferred at a controllable magnitude to the input and/or output region, wherein the controllable semiconductor switch is stationary with respect to the bus bar arrangement while the objects are moved.

2. The electrophoretic dip coating plant of claim 1, wherein the controllable semiconductor switch comprises a power transistor and a logic circuit, wherein the logic circuit is programmed such that it delivers pulse-width-modulated pulses at a certain repetition frequency to turn on the power transistor.

3. The electrophoretic dip coating plant of claim 2, wherein the logic circuit is programmed such that on the basis of a start signal it generates pulses initially with a small width and then, over a certain time, pulses with an increasing width.

4. The electrophoretic dip coating plant of claim 3, wherein a presence sensor is disposed in the inlet region of the dip tank and delivers the start signal to the logic circuit when an object approaches.

5. The electrophoretic dip coating plant of claim 1, wherein a presence sensor is disposed in the end portion of the input region of the bus bar arrangement which is adjacent to the main region of the bus bar arrangement and/or in the end portion of the main region which is adjacent to the output region, which sensor, when an object approaches, delivers a signal to the logic circuit, whereby the input and/or the output region of the bus bar arrangement is brought to the potential of the main region.

6. The electrophoretic dip coating plant of claim 1, further comprising a plurality of main regions, of the bus bar arrangement, which can be adjusted to different potentials, wherein at least two adjacent main regions are connected in an appropriate manner by the controllable semiconductor switch, for the connection between the input region and the main region of the bus bar arrangement.

* * * * *